United States Patent [19]

Himes et al.

[11] 4,165,215

[45] Aug. 21, 1979

[54] SLAB PREPARATION APPARATUS

[75] Inventors: Herman C. Himes, Akron; John P. Koepnich, Cuyahoga Falls, both of Ohio

[73] Assignee: Price Brothers Company, Dayton, Ohio

[21] Appl. No.: 880,195

[22] Filed: Feb. 22, 1978

[51] Int. Cl.[2] ..... B28B 7/00

[52] U.S. Cl. ..... 425/169; 249/53 R; 425/213

[58] Field of Search ..... 425/62, 64, 88, 169, 425/219, 213; 280/32.5, 32.6; 249/53

[56] References Cited

U.S. PATENT DOCUMENTS

| | | | |
|---|---|---|---|
| Re. 14,371 | 10/1917 | Dietrich | 249/53 |
| 1,756,803 | 4/1930 | Williams | 280/32.5 |
| 2,583,358 | 1/1952 | Cesan | 280/32.5 |
| 3,523,343 | 8/1970 | Mitchell | 425/111 |
| 3,732,052 | 5/1973 | Gunia | 425/88 |

*Primary Examiner*—John McQuade
*Attorney, Agent, or Firm*—Biebel, French & Nauman

[57] ABSTRACT

Preparation of precast concrete slabs on a casting bed is facilitated through the use of a lay-out cart which moves along over the bed on wheels which engage parallel rails on opposite sides of the casting bed. Production hardware for a days casting can be loaded on the cart and positioned at the proper longitudinal and transverse positions on the bed by workmen riding on the cart and placing the hardware on the bed through an access opening formed through the cart. The access opening is preferably at least as wide as the bed to provide access to the bed across its entire width, and a fixed scale and movable indicator are associated with the access opening to locate specific positions transversely of the bed. A longitudinal scale extends the length of the bed and the cart carries an indicator which is movable along the longitudinal scale to locate positions along the length of the bed.

7 Claims, 4 Drawing Figures

SLAB PREPARATION APPARATUS

BACKGROUND OF THE INVENTION

One process of constructing precast concrete slabs utilizes a fixed casting bed and a movable extruder which moves along tracks positioned longitudinally of the bed to extrude a relatively stiff mix of concrete onto the bed.

Prior to extruding the concrete onto the casting bed it is generally necessary to perform several preparatory operations. For example, it is desirable to spray the casting bed with a release agent to facilitate removal of the hardened concrete slab. Prestressing strands are usually used in slabs of this type and the strands must first be laid in the bed before they are anchored and prestressed.

Very often various types of production hardware, such as bolt sockets, anchors, plates and other accessories are cast in the slab, as well as blockouts, usually of foamed plastic, for forming openings in the finished slab.

Traditionally all of the above operations have required several workmen walking on the bed, which may be in excess of one hundred feet in length, and some eight feet or more in width. The placement of hardware on the bed is particularly time consuming and requires hauling each piece of hardware to the bed, and measuring the bed longitudinally and transversely with a tape measure or the like to locate the exact position on the bed of that particular piece of hardware.

The above operations obviously increase appreciably the production time involved as well as the labor costs necessary to produce a precast concrete slab.

SUMMARY OF THE INVENTION

The present invention provides precast concrete slab preparation apparatus which includes a lay-out cart acting in combination with a conventional casting bed to facilitate many of the precasting operations.

More specifically, a lay-out cart is provided having an access opening formed through it and movable along the tracks normally used by the extrusion casting machine. Workmen riding on the cart can rapidly spray a release agent on the bed while riding down the bed on the lay-out cart, and the placing of prestressing strand is greatly simplified since workmen riding on the cart can in one continuous operation unreel several strands simultaneously and place them on the bed as the cart moves down its tracks.

The positioning of production hardware on the casting bed can proceed much more expeditiously than in the conventional operations decribed above, since sufficient hardware for a full days casting can be loaded on the cart and placed precisely on the bed through the use of longitudinal and transverse indexing means associated with the cart.

The indexing means include a longitudinal scale fixed with respect to the bed and extending longitudinally thereof and an indicator mounted on the cart and movable along the longitudinal scale. A transverse scale is mounted in the access opening through the cart and indicators are movable along the transverse scale to determine the precise transverse position for a piece of hardware, blockout or the like.

From the above and the following detailed description, it will be seen that the present invention provides slab preparation apparatus which greatly facilitates precasting operations and reduces production time and costs.

DESCRIPTION OF THE PREFERRED EMBODIMENTS

Figure 1:
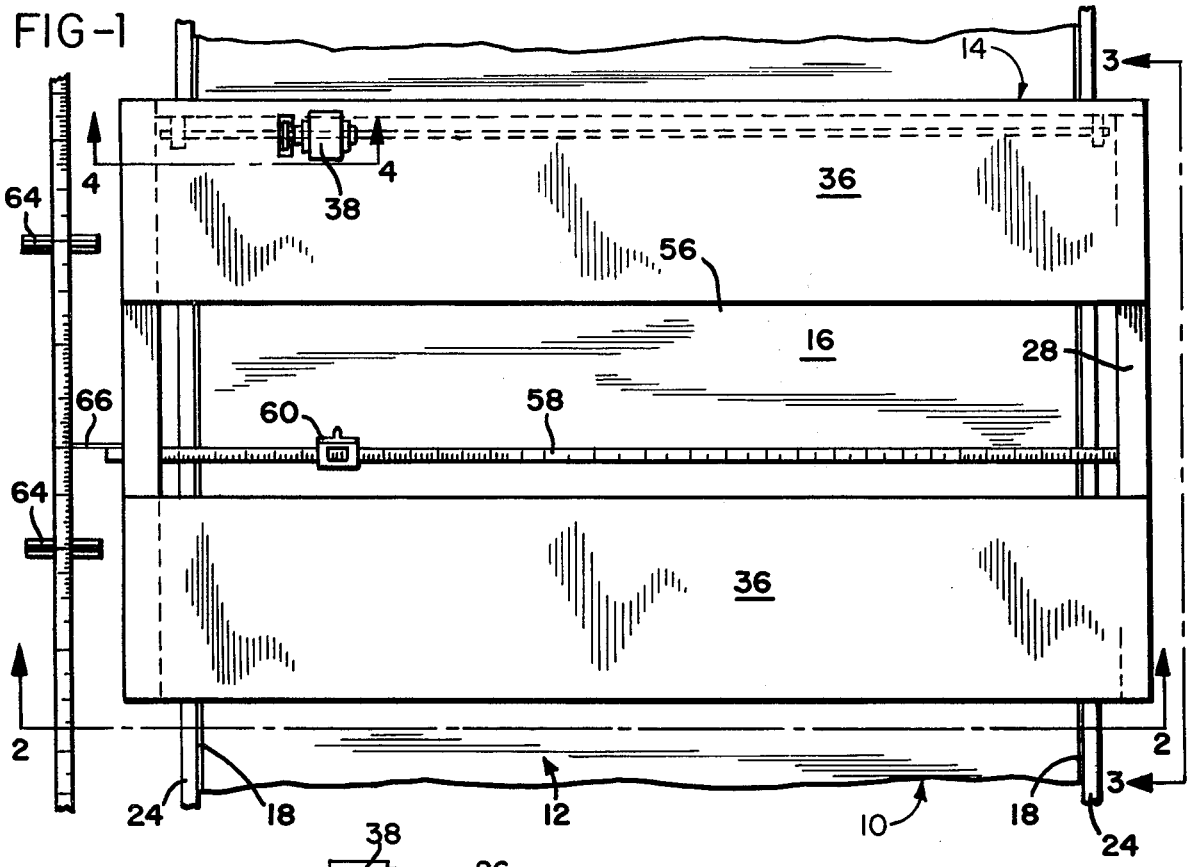
FIG. 1 is a plan view showing a lay-out cart and a portion of the associated casting bed in accordance with the present invention.
Figure 2:
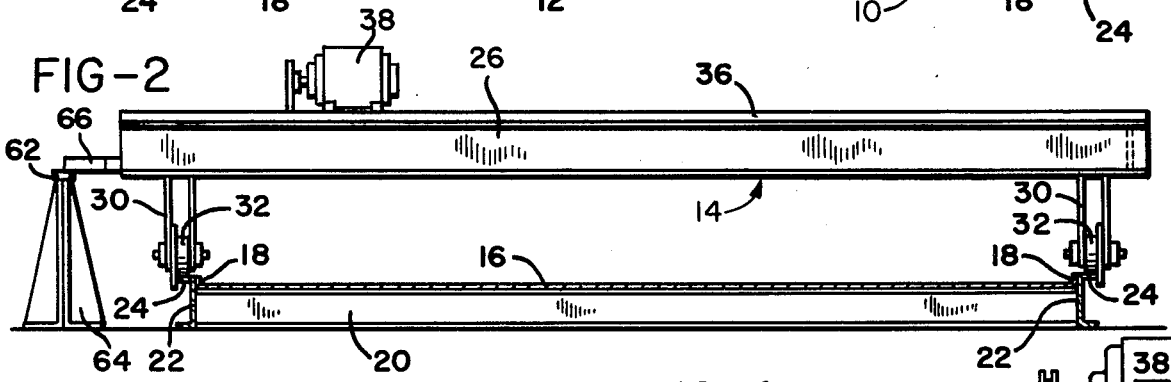
FIG. 2 is a view taken along line 2—2 of FIG. 1.
Figure 3:
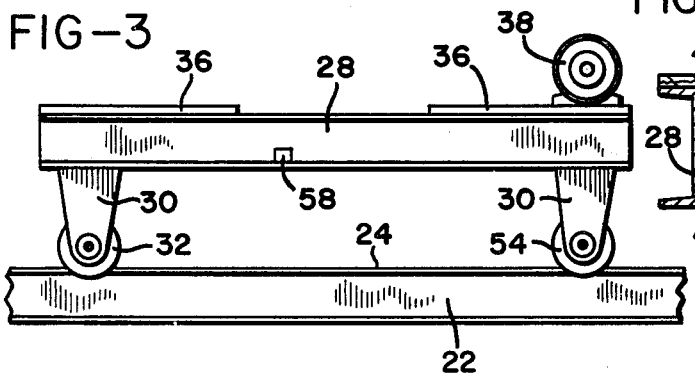
FIG. 3 is a view taken along line 3—3 of FIG. 1.

As seen in the drawings the slab preparation apparatus 10 of the present invention includes a casting bed 12 and a lay-out cart 14. The casting bed may take a variety of forms, but generally it will include a smooth metal sheet 16 which may have up-turned, longitudinally extending flanges 18, and be supported by transverse structural members 20 extending between longitudinally extending channels or other structural supports 22, the upper flanges 24 of which may also function as tracks or rails.

Figure 4:
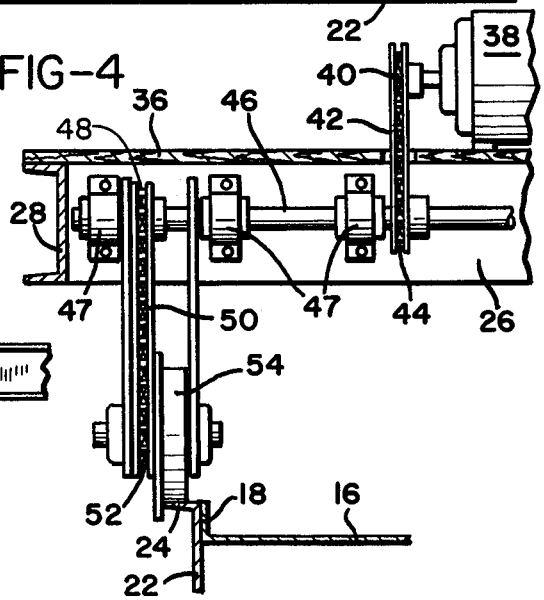
FIG. 4 is a view taken along line 4—4 of FIG. 1.

The lay-out cart 14 is constructed of suitable transverse and longitudinally extending structural members 26 and 28, respectively, from which depend brackets 30 journalling wheels 32 which engage the tracks or rails 24. A deck 36 is carried by the structural framework of the cart and one portion of the deck carries a motor 38 which, through a toothed sprocket 40, chain 42 and driven sprocket 44, rotates a drive shaft 46. Drive shaft 46 is journalled in bearings 47 mounted on one of the transverse structural members 26 and carries a pair of sprockets 48, only one of which is shown in FIG. 4, which through chains 50 and sprockets 52 drive wheels 54 with which the sprockets 52 are associated. Suitable controls (not shown) for the above described drive system can be provided as desired.

The deck 36 is provided with an opening 56 which extends completely across the lay-out cart 14 and is at least as wide as the width of the casting bed 12 to provide access to the bed across its entire width. Mounted in the opening 56 is a transverse scale 58 which is fixed with respect to the cart and carries one or more transverse indicators 60 slidable along the transverse scale 58. A longitudinal scale 62 is mounted on suitable supports 64 and extends longitudinally of the casting bed 12, and an indicator 66 is fixed with respect to the cart and cooperates with the longitudinal scale 62 as the cart moves along over the bed to indicate longitudinal positions on the bed surface.

The transverse scale 58 and indicator or indicators 60, and the longitudinal scale 62 and indicator 66 thus provide a coordinate set of indexing means for locating precisely without the use of tape measures or other measuring devices the positions on the bed 12 where hardware, blockouts and similar pieces must be placed.

In operation, once the bed has been cleaned, workmen riding on the cart can move along over the bed spraying a release agent on the cleaned bed surface. Thereafter several strands of reenforcing wire can be simultaneously unreeled and laid on the bed, again by workmen riding the lay-out cart down the casting bed. In each instance the workmen need not walk along the cleaned bed as in conventional operations and the spraying and strand laying operations can be performed much more quickly.

With regard to the placement of hardware, blockouts and other material on the casting bed prior to concrete placement, rather than one or two pieces being manually carried to the bed and positioned on the bed by workmen walking along the the bed and using tape measures or rulers, an entire day's supply of production hardware can be loaded on the cart 14. One or more workmen riding on the cart will then move down the bed, stopping at appropriate longitudinal positions as indicated by the indicator 16 moving along the longitudional scale 62, and placing pieces of eqiupment at appropriate transverse locations as indicated by the indicator 60 moving along the transverse scale 50.

From the above it will be seen that the present invention provides improved slab preparation apparatus which greatly expedites production and decreases associated labor costs.

While the form of apparatus herein described constitutes a preferred embodiment of the invention, it is to be understood that the invention is not limited to this precise form of apparatus, and that changes may be made therein without departing from the scope of the invention.

What is claimed is:

1. In apparatus for preparing a precast concrete slab including a relatively long, narrow casting bed and tracks extending along opposite sides of said bed, the improvement comprising:

a lay-out cart including a deck spanning said bed transversely thereof, means for moving said cart along said tracks, means defining an opening through said deck providing access from said deck to said bed, said opening having a width no less than the width of said bed, and indexing means associated with said cart for indicating positions relative to said bed.

2. The apparatus of claim 1 wherein:

said tracks comprise rails positioned along opposite sides of said casting bed, and said moving means include wheels mounted on said cart and engaging said rails.

3. The apparatus of claim 2 wherein:

said moving means further includes a motor driving said wheels.

4. The apparatus of claim 1 wherein:

said indexing means includes means for indicating positions longitudinally and transversely of said casting bed.

5. The apparatus of claim 4 wherein:

said longitudinal position indicating means comprises a stationary scale extending longitudinally of said casting bed, and an indicator fixed with respect to said cart and movable along said longitudinally extending scale.

6. The apparatus of claim 4 wherein said transverse position indicating means comprises:

a transverse scale fixed with respect to said cart and extending transversely of said casting bed, and a transverse indicator mounted on said cart and movable along said transverse scale.

7. In apparatus for preparing a precast concrete slab including a casting bed having a length several times its width and rails extending along opposite sides of said bed, the improvement comprising:

a lay-out cart including a deck spanning said bed transversely thereof, motor driven wheels carried by said cart and engaged with said rails, means defining an opening through said deck of a width at least as great as said width of said bed, a longitudinal scale fixed with respect to said bed and extending longitudinally thereof, a longitudinal indicator fixed with respect to said cart and movable therewith along said longitudinal scale, a transverse scale associated with said opening through said deck of said cart and extending substantially the entire width of said bed, and a movable transverse indicator carried by said cart and movable along said transverse scale.

* * * * *